US006656294B1

(12) United States Patent
Kawamoto et al.

(10) Patent No.: US 6,656,294 B1
(45) Date of Patent: Dec. 2, 2003

(54) METHOD OF REDUCING ELUTION OF LEAD IN LEAD-CONTAINING COPPER ALLOY, AND DRINKING WATER SERVICE FITTINGS MADE OF LEAD-CONTAINING COPPER ALLOY

(75) Inventors: Masashi Kawamoto, Kita-kyushu (JP); Akira Gotou, Kita-kyushu (JP); Mituo Imamoto, Kita-kyushu (JP)

(73) Assignee: Toto Ltd., Kita-Kyushu (JP)

( * ) Notice: Subject to any disclaimer, the term of this patent is extended or adjusted under 35 U.S.C. 154(b) by 0 days.

(21) Appl. No.: 09/586,608

(22) Filed: Jun. 2, 2000

Related U.S. Application Data

(63) Continuation of application No. PCT/JP98/05429, filed on Dec. 2, 1998.

(51) Int. Cl.[7] ..... C23C 22/00

(52) U.S. Cl. ..... 148/243; 148/255; 148/258; 148/264; 148/265; 148/267; 148/268; 148/269; 148/282; 216/105; 216/106; 216/107; 216/10; 29/890.141

(58) Field of Search ..... 148/243, 255, 148/264, 258, 265, 268, 267, 269, 282; 216/105, 106, 107, 10; 29/890.141

(56) References Cited

U.S. PATENT DOCUMENTS 2,494,909 A * 1/1950 Spurance, Jr. et al. ..... 148/241
3,514,343 A * 5/1970 Bauman ..... 148/267

(List continued on next page.)

FOREIGN PATENT DOCUMENTS

| | | |
|---|---|---|
| JP | 50-148253 | 11/1975 |
| JP | 53-52252 | 5/1978 |
| JP | 53-106637 | 9/1978 |
| JP | 64-8278 | 1/1989 |
| JP | 2-274900 | 11/1990 |
| JP | 4-354900 | 12/1992 |
| JP | 7-11481 | 1/1995 |
| JP | 10-72683 | 3/1998 |
| WO | WO97/06313 | 4/1996 |
| WO | WO 97/06313 * | 2/1997 |

OTHER PUBLICATIONS

The American Heritage Dictionary of the English Language, Third Edition, Houghton Mifflin Company, 1992.*

Derwent Abstract of Japanese Patent JP 60162790A, Aug. 24, 1985.*

(List continued on next page.)

*Primary Examiner*—John Sheehan
*Assistant Examiner*—Andrew L. Oltmans
(74) *Attorney, Agent, or Firm*—Michael D. Bednarek; Shaw Pittman LLP

(57) ABSTRACT

It is an object of the present invention to provide a processing method for preventing elution of lead in a lead-containing copper alloy to prevent lead from eluting from a faucet metal, etc. made of a lead-containing copper alloy, and a drinking water service fitting made of a lead-containing copper alloy in which elution of lead has been prevented. By forming a chromate film on the surface of a lead-containing copper alloy material, it is possible to reduce elution of the lead left in a limited amount on the surface. A drinking water service fitting made of a lead-containing copper alloy is immersed in an alkaline etching solution in a pre-processing step for a nickel chromium plating step to selectively remove lead on the surface of the lead-containing copper alloy material and is then activated in a solution such as sulfuric acid and hydrochloric acid. Nickel plating is subsequently effected, and then chromium plating is effected in a sargent chromium or chromium fluoride bath, and a chromate film may be formed by immersing the drinking water service fitting in a chromate solution.

16 Claims, 7 Drawing Sheets

$$\cdot\ Pb + 2NaOH \rightarrow Na_2PbO_2 + H_2 \cdots\cdots (1)$$

$$\left.\begin{array}{l} \cdot\ 2Pb + O_2 \rightarrow 2PbO \\ \quad (\text{Oxidant}) \\ \cdot\ PbO + 2 \cdot NaOH \rightarrow Na_2PbO_2 + H_2O \end{array}\right\} \cdots (2)$$

U.S. PATENT DOCUMENTS

| | | | | | |
|---|---|---|---|---|---|
| 5,454,876 | A | * | 10/1995 | Downey | 134/3 |
| 5,544,859 | A | * | 8/1996 | Coltrinari et al. | 251/368 |
| 5,601,658 | A | | 2/1997 | Marinas et al. | |
| 5,879,532 | A | * | 3/1999 | Foster et al. | 205/192 |
| 5,958,257 | A | | 9/1999 | Regelbrugge et al. | |

OTHER PUBLICATIONS

American Water Works Association, Proceedings 1993 Water Quality Technology Conference (Nov. 7–11, 1993).

English Language Abstract of JP 64–8278.

Gerrety, J., "Lead, water bad mix," Journal and Courier (Aug. 31, 1993).

Kotulak, R. et al., "Lifeline for newborns: Gentler technique for treating babies' lung disorders found," Tribune (1993), (no month date).

Olsztynski, J., "Getting the Lead Out," PHC Profit Report, (Oct. 1, 1993).

Jiang, Y., et al., "Ion–Exchange Treatment of Spent Brass Fixture 'Deleadification Solution," Poster Presentations No. 12 (no date).

Purdue University, Proceedings of the 49th Industrial Waste Conference (May 9–11, 1994).

Tally, L., "Getting the Lead Out," Purdue University Newsletter, Civil Engineering Transitions (1994), (no month data).

Abstract, Plating Technique Guidebook (1987), (no month data).

Marinas et al., "Control of Drinking–Water Lead–Contamination Contributed by Brass Plumbing Fixtures", p. 945–972, (no date).

Bogard, Connie L., "Control of Lead Contamination in Drinking Water from Brass Plumbing Fixtures," Thesis at Purdue University, May 1992.

* cited by examiner

FIG. 1

| Composition of alkaline solution for immersion | | | | Lead concentration (ppb) | |
|---|---|---|---|---|---|
| Main components | Oxidant | Chelating agent | Surface active agent | Alkaline immersion only | Immersion in chromic acid after immersion in alkaline solution |
| Untreated sample | — | — | — | 500 | |
| Sodium orthosilic acid 50g/1 (pH about 13) | — | — | — | 90 | 50 |
| Sodium hydroxide 50g/1 (pH about 14) | — | — | — | 80 | 30 |
| Sodium hydroxide 50g/1 | Meta-nitrobenzene sodium sulfonate Sodium 10g/1 | — | — | 61 | 17 |
| Sodium hydroxide 50g/1 | Sodium hypochlorite 30mg/1 | — | — | 68 | 19 |
| Sodium hydoxide 50g/1 | Meta-nitrobenzene sodium sulfonate Sodium 2g/1 | EDTA 2g/1 Ethylene diamine 2g/1 | — | 53 | 12 |

FIG. 2

| Type of chromium plating solution | Lead concentration (ppb) |
|---|---|
| Immersion in alkaline solution only (No immersion in chromium plating solution) | 53 |
| Sargent chromium plating bath consisting of chromic anhydride (200g/1) and sulfuric acid (2g/1) | 18 |
| Chromium fluoride plating bath on the market (F content of about 1g/1) | 12 |

FIG. 3

| No. | Composition of chromate solution | | | | Lead concentration (ppb) |
|---|---|---|---|---|---|
| | Chromic anhydride | 85% phosphoric acid | 96% sulfuric acid | 60% Nitric acid | |
| 1 | 15 g/1 | 10m l/1 | 5m l/1 | 5m l/1 | 2 |
| 2 | 15 g/1 | 10m l/1 | 5m l/1 | — | 2 |
| 3 | 15 g/1 | — | 5m l/1 | 5m l/1 | 9 |
| 4 | — | 10m l/1 | 5m l/1 | 5m l/1 | 10 |
| 5 | No chromate step available (Immersion in chromium acid only after immersion in alkaline etching solution) | | | | 12 |

$$Pb + 2NaOH \rightarrow Na_2PbO_2 + H_2 \quad \cdots\cdots (1)$$

$$\left.\begin{array}{l} 2Pb + O_2 \rightarrow 2PbO \\ \quad \text{(Oxidant)} \\ PbO + 2NaOH \rightarrow Na_2PbO_2 + H_2O \end{array}\right\} \cdots (2)$$

$$Pb^{2+} + CrO_4^{2-} \rightarrow PbCrO_4 \quad \cdots (3)$$

$$PbCrO_4 + H_2SiF_6 \rightarrow PbSiF_6 + H_2CrO_4 \quad \cdots (4)$$

- $Me^{2} \rightarrow Me^{2+} + 2e^-$
  ($Pb \rightarrow Pb^{2+} + 2e^-$)
- $CrO_4^{2-} + 8H^+ + 3e^- \rightarrow Cr^{3+} + 4H_2O$
- $CrO_4^{2-} + Cr^{3+} + H^+ \rightarrow Cr_2O_3 \cdot CrO_3 \cdot xH_2O \downarrow$ Chromate film

METHOD OF REDUCING ELUTION OF LEAD IN LEAD-CONTAINING COPPER ALLOY, AND DRINKING WATER SERVICE FITTINGS MADE OF LEAD-CONTAINING COPPER ALLOY

This is a continuation of International Appln. No. PCT/JP98/05429 filed Dec. 2, 1998 which designated the U.S.

BACKGROUND OF THE INVENTION

1. Field of the Invention

The present invention relates to a processing method for reducing elution of lead from a lead-containing copper alloy, a plating method for reducing elution of lead in a lead-containing copper alloy, and a drinking water service fitting made of a lead-containing copper alloy which exhibits reduced elution of lead.

The drinking water service fittings include those which are directly connected to a feed water pipe, such as water heater, water cooler, ice-maker, water purifier, hot water boiler, vending machine, pole tap, low tank, valve (faucet metals), joint, pipe, sink, wash stand, stool, bath tub, housing unit, etc.

2. Description of the Prior Art

Hitherto, faucet metals have been generally manufactured by casting or forging a copper alloy such as bronze or brass, cutting and polishing to shape, and then nickel chromium plating, etc.

To improve machinability of the copper alloy during cutting in a manufacturing process, lead is added to the copper alloy.

FIG. 7 is a schematic view of composition of the copper alloy to which lead is added. When lead is added to the copper alloy 1, lead, lead oxide, lead hydroxide or the like gather near the surface of the copper alloy, while lead 2 exists as a simple substance in the inside thereof. The concentration of the lead 2 near the surface is several times higher than that of lead on the inside.

In the faucet metals made of bronze casting to which lead is added, lead of about 500 ppb elutes. Thus, lead elutes from the surface of a water flow channel of the drinking water service fittings made of a lead-containing copper alloy into water and as a result, there is the possibility that drinking of such water for a long time will exert a bad influence on a human body.

However, copper alloy materials to which lead is not added has poor machinability, and a substitute copper alloy material has not yet been developed.

SUMMARY OF THE INVENTION

It is, therefore, an object of the present invention to provide a processing method for preventing elution of lead in a lead-containing copper alloy by removing lead from the surface of a lead-containing copper alloy material to prevent lead from eluting from a faucet metal, etc. made of a lead-containing copper alloy, a plating method for reducing elution of lead in a lead-containing copper alloy, and a drinking water service fitting made of a lead-containing copper alloy in which elution of lead has been prevented.

The present invention pays attention to a property of lead as an amphoteric metal, wherein a lead-containing copper alloy is immersed in an alkaline etching solution to which an oxidant is added, to selectively dissolve and remove lead on the surface of a lead-containing copper alloy material.

Thus, both a chemical reaction whereby lead on the surface of a lead-containing copper alloy material contacts an alkaline solution so as to directly become an alkali metal salt of a water-soluble zincate, and a chemical reaction whereby the lead is first converted to lead oxide by an oxidant and this lead oxide is converted to an alkali metal salt of a water-soluble zincate by an alkaline solution, proceed together. However, the chemical reaction of the latter advances faster than that of the former and as a result, dissolution of lead is expedited to remove lead.

When this chemical reaction occurs, copper (a simple substance), tin forming an alloy together with copper, zinc, aluminum, etc. do not react to the alkaline solution, and only the lead (a simple substance) which does not form an alloy together with copper is selectively removed by the above-mentioned chemical reaction.

It is desirable to further add a chelating agent to this etching solution. By adding the chelating agent, lead is formed with a water-soluble complex and it is possible to effectively remove lead.

Further, it is desirable to form a chromate film on the surface of a lead-containing copper alloy material after lead on the surface of the lead-containing copper alloy material is dissolved and removed.

Namely, a chemical reaction that dissolves a lead-containing copper alloy, and a chemical reaction that forms a chromate film are caused by chromic acid contained in a chromate solution so as to dissolve and remove the lead left in a limited amount on the surface of a lead-containing copper alloy material. Also, the surface of the lead-containing copper alloy material from which lead has been removed is protected by a chromate film. Lead on the inside does not elute even though the surface of the lead-containing copper alloy material from which lead has been removed corrodes due to long term water flow. It is therefore possible to reduce elution of lead for a long period.

Further, the present invention pays attention to the point that in a plating step such as nickel chromium plating to be effected on a lead-containing copper alloy, this alloy is usually immersed in a plating solution. The outer surface of the lead-containing copper alloy is therefore plated and, at the same time, lead on the inner surface is dissolved and removed.

An alkaline degreasing solution is used as a pre-cleaning step for plating, but an oxidant is contained in the solution to expedite dissolution and removal of lead on the inner surface of a lead-containing copper alloy material. Also, addition of fluoride to a chromium plating solution serves to effectively dissolve deposits of lead chromate.

Further, a lead-containing copper alloy material may be immersed in a chromate solution to form a chromate film on the inner surface thereof after plating the outer surface thereof. With this film formation, it is possible to reduce elution of lead left in a limited amount on the surface of the lead-containing copper alloy material. It is desirable to add a phosphoric acid to the chromate solution.

The lead-containing copper alloy material is degreased in an alkaline degreasing solution as a cleaning step before plating in a solution in which an oxidant is contained. Acid activation and nickel plating are subsequently effected and then, chromium plating is effected in a chromium plating solution that contains fluoride. Thus, it is possible to dissolve and remove lead on the inner surface of the lead-containing copper alloy material while effecting nickel chromium plating on the outer surface thereof.

Further, the lead-containing copper alloy material is degreased in an alkaline degreasing solution as a cleaning step before plating in a solution which contains an oxidant.

Acid activation and nickel plating are subsequently effected and then, chromium plating is effected in a sargent chromium plating bath or a chromium fluoride plating bath. The lead-containing copper alloy material is further immersed in a chromate solution to form a chromate film on the inner surface thereof. It is possible to dissolve and remove lead on the inner surface of the lead-containing copper alloy material while effecting nickel chromium plating on the outer surface thereof. It is desirable to include a phosphoric acid in the chromate solution.

The faucet metals mainly use a lead-containing copper alloy material such as bronze or brass, and various plating steps are effected to improve the beauty of the outer surface, corrosion resistance, and wear and abrasion resistance. According to the present invention, plating is effected on the outer surface of the lead-containing copper alloy material while reducing elution of lead on the inner surface thereof at the same time. It is therefore possible to reduce elution of lead in various plating steps including nickel chromium plating.

BRIEF DESCRIPTION OF THE DRAWINGS

FIG. 1 is a view showing an elution effect on lead when lead elutes by alkaline etching;

FIG. 2 is a view showing an analytical result of the concentration of lead elution when chromium plating bath treatment is effected after alkaline etching;

FIG. 3 is a view showing an analytical result of the concentration of lead elution when a chromate process is effected after alkaline etching;

DETAILED DESCRIPTION OF THE PREFERRED EMBODIMENTS

Figure 4:
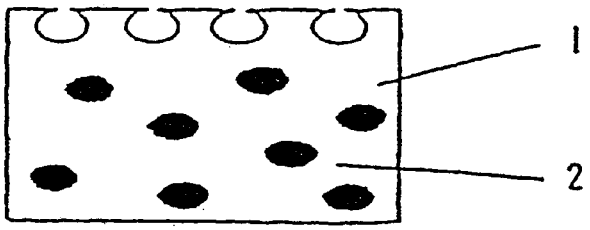
FIG. 4 is a schematic view showing the condition where lead has been eluted by alkaline etching.

The present invention pays attention to the property of lead as an amphoteric metal, wherein a lead-containing copper alloy is immersed in an alkaline etching solution to which an oxidant has been added to selectively dissolve and remove lead on the surface of a lead-containing copper alloy material. Also, the lead-containing copper alloy is immersed in a chromic acid solution to dissolve lead on the surface thereof. It is also possible to dissolve and remove lead on the surface of the lead-containing copper alloy material by immersing the lead-containing copper alloy in the alkaline etching solution, and then immersing the same in a chromic acid solution. When any one or a plurality of an oxidant, chelating agent and surface active agent are added to the alkaline etching solution, and when fluoride is added to a chromic acid solution, it is possible to effectively remove lead.

A chromate film may also be formed on the surface of a lead-containing copper alloy material. With this film formation, it is possible to reduce elution of the lead left in a limited amount on the surface. A drinking water service fitting made of a lead-containing copper alloy is immersed in an alkaline etching solution in a pre-processing step for a nickel chromium plating step to selectively remove lead on the surface of the lead-containing copper alloy material and is then activated in a solution such as sulfuric acid and hydrochloric acid. Nickel plating is subsequently effected, and then chromium plating is effected in a sargent chromium or chromium fluoride bath, and a chromate film may be formed by immersing the drinking water service fitting in a chromate solution.

When chromium plating is effected in a chromium fluoride plating bath where fluoride has been substituted for a part or all of sulfuric acid in a sargent bath consisting of ordinary sargent chromium or chromic acid anhydride and sulfuric acid, a chromic acid solution will not only dissolve the entire copper alloy material, but also dissolve lead because the chromic acid solution contained in a chrome plating bath is a strong acid.

Thus, it is possible to effect nickel chromium plating on the outer surface of the drinking water service fitting and at the same time, to remove lead on the surface of a water flow channel of the inner surface thereof.

A plating process usually consists of a degreasing step and a plating step. The degreasing step is a step for removing stains such as a grease component attached to a material to secure adhesion of plating. A main component of the alkaline etching solution which is used in the present invention is an alkaline solution that has dissolved any one or several kinds of sodium hydroxide, potassium hydroxide, sodium carbonate, sodium phosphate, sodium tripolyphosphate, sodium metasilicate, sodium orthosilic acid, etc. The concentration is general between several grams/1 and several tens of grams/1 and it can be selectively decided depending on the combination of the components used therein.

A temperature of about 60–90° C. is desirable because the higher the temperature, the higher the effect of lead elution. Immersion time of between several minutes and several tens of minutes is desirable. As shown in FIG. 4, a copper metal does not generally infiltrate, but it is possible to selectively dissolve lead as an amphoteric metal. The plating process usually consists of a degreasing step and a plating step. The degreasing step is a step for removing stains such as a grease component attached to a material to secure the adhesion of plating. An alkaline etching solution used in the present invention acts as an alkaline degreasing solution.

To improve penetration and wettability of an alkaline etching solution, a surface-active agent is added for the purpose of reducing surface tension of the solution. An anionic surface-active agent or a nonionic surface-active agent is mainly used as the surface-active agent and these can be used alone or together. The anionic surface-active agent includes higher fatty acid sodium, sulfonated oil, higher alcohol sodium sulphate, alkylbenzene sodium sodium sulphate, higher alkyl ether sodium sulphate, and alpha olefin sodium sulphate.

Also, the nonionic surface-active agent includes alkyl polyoxyethylene ether, alkyl phenyl polyoxyethylene ether, fatty acid ethylene oxide adduct, polypropylene glycol ethylene oxide adduct (Pluronic). An amount of addition between several grams/1 and several tens of grams/1 is general.

It is also possible to add a chelating agent to prevent reattaching of lead as hydroxide and to expedite dissolution of lead. Desirable as the chelating agent, for example, is an chemical compound which can easily form a complex together with lead of EDTA, ethylene diamine, triethanolamine, thiourea, Rochelle salt and tartaric acid, etc. A concentration between several grams/1 and several tens of grams/1 is desirable for each component.

When an oxidant is added in an alkaline etching solution, lead is oxidized and dissolves in alkali through lead oxide (PbO, etc. [reaction formula (2) of FIG. 4]. This reaction (2) is effected faster than the reaction (1) and as a result, expedites dissolving lead. Used as the oxidant, for example, are an organic oxidizing compound such as meta-nitrobenzene sodium sulfonate, P-nitro sodium bonzoate, and an inorganic compound such as hypochlorite, bleaching powder, hydrogen peroxide, potassium permanganate, persulfate, and perchlorate. A concentration between several grams/1 and several tens of grams/1 is desirable for each component.

A chromium fluoride bath is available as a bath used for chromic acid immersion. This chromic fluoride bath can use a generally well-known sargent chromium plating bath, but the fluoride is substituted for a part or all of sulfuric acid in a sargent bath consisting of chromic acid anhydride and sulfuric acid.

Figure 5:
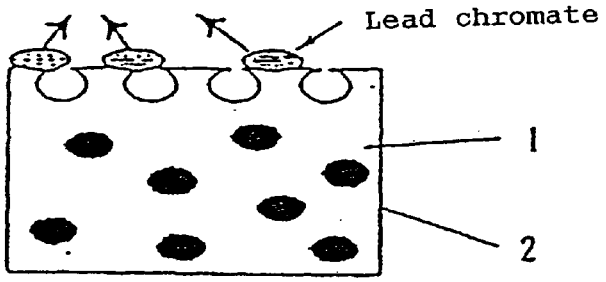
FIG. 5 is a schematic view showing the condition of a plating bath treatment in a chromium fluoride bath.

When chromium plating is effected in a chromium plating solution, chromium plating is effected on the outer surface of a copper alloy material, but the entire part of the inner surface dissolves while lead dissolves because the chromium plating solution has strong acidic properties. However, there is the possibility that deposits remain as lead chromate when fluoride does not exist [reaction formula (3) in FIG. 5]. Since fluoride serves to dissolve such deposits, it is desirable to effect chromium plating in the chromium fluoride bath [reaction formula (4) in FIG. 5]. A temperature between 40° C. and 60° C. and immersion time between several tens of seconds and several minutes are desirable respectively.

Used as fluoride are almost all the fluorine compounds such as sodium fluoride, potassium fluoride, ammonium fluoride, hydrofluoric acid, boro-hydrofluoric acid, hydrofluosilic acid, sodium silicofluoride, potassium silicofluoride, and boro-chromium fluoride.

An additive agent used in a chromate processing is based on chromic acid anhydride, phosphoric acid and sulfuric acid, but nitric acid, hydrofluoric acid, acetic acid, oxalic acid, chromate, etc. are added or substituted as the case may be. A chromate agent such as a galvanizing agent on the market may be used.

Figure 6:
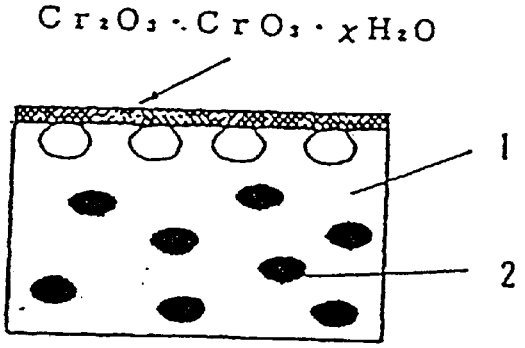
FIG. 6 is a schematic view showing the condition of a chromate treatment.
Figure 7:
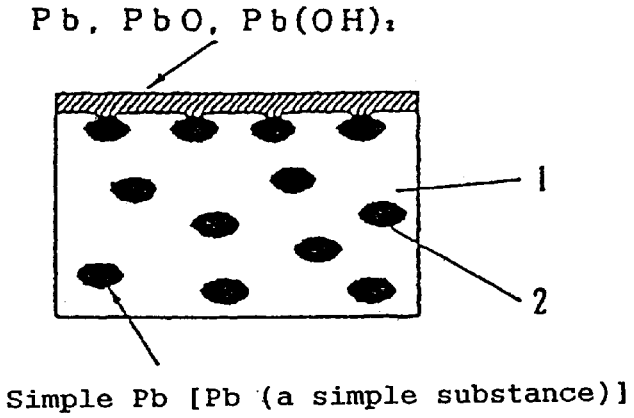
FIG. 7 is a schematic view showing the composition of a copper alloy to which lead has been added.

A concentration between several grams/1 and several tens of grams/1 is desirable for each component. A processing temperature between room temperature and 60° C., and a processing time between several seconds and several minutes are desirable respectively. By immersing a completed product with its outer surface plated in this chromate solution, a chromate film can be formed on the inner surface by a reaction formula, as shown in FIG. 6, to control elution of lead. By adding phosphoric acid to chromic acid anhydride which is the main component of the chromate solution, it is possible to improve the control effect of lead elution with a synergistic effect.

(1) Alkaline Etching Solution

A lead elution effect of the alkaline etching solution and a lead elution effect when an oxidant and a chelating agent are added to the alkaline etching solution are shown in FIG. 1.

Processing is effected in the following steps. Faucet metals made of bronze casting are immersed in various etching solutions as shown in FIG. 1 for 3 minutes at 80° C., and then washed for 30 seconds. They are subsequently immersed in a chromium fluoride plating solution on the market with a fluorine contents of about 1 gram/1, for 3 minutes at 45° C. and then washed for 30 seconds. These metals are subsequently washed with hot water for 30 seconds at 60° C.

Processed faucet metals were then analyzed to see the concentration of lead eluted in accordance with "Drinking water service fittings—Percolation performance test method" by JIS S 3200-7 (1997). FIG. 4 is a schematic view showing the condition where lead is eluted by the alkaline etching, wherein lead 2 on the surface of a lead-containing copper alloy 1 is selectively removed by a reaction formula as shown in FIG. 4.

As can be seen from the results in FIG. 2, an untreated sample without etching has a lead elution amount of 500 ppb, while the lead elution amount for the products treated according to the present invention is remarkably reduced. In particular, the lead elution amount of the treated products was further reduced by addition of the oxidant and the chelating agent. It is to be noted that immersion of the products in the chromium fluoride plating solution enables the lead elution amount to be reduced further.

(2) Chromium Plating Solution

Next, faucet metals made of bronze casting are immersed in an alkaline etching solution (sodium hydroxide 50 g/1, meta-nitrobenzene sodium sulfonate 2 g/1, EDTA 2 g/1, ethylene diamine 2 g/1) for 3 minutes at 80° C. and then washed for 30 seconds. The faucet metals are subsequently immersed in a chromium plating solution as shown in FIG. 2 for 3 minutes at 45° C., washed for 30 seconds, and then washed with hot water for 30 seconds at 60° C. The faucet metals were then analyzed to obtain the concentration of lead elution in accordance with JIS S 3200-7 (1997). The result of this analysis is shown in FIG. 2.

As seen from FIG. 2, the lead elution amount is remarkably reduced when immersed in the chromium plating solution, but the chromium fluoride bath is more effective than the conventional sargent chromium bath. The sargent bath where fluoride does not exist is considered to have had a slightly higher concentration of lead because deposits remain as lead chromate [reaction formula (3) of FIG. 5]. The fluoride, which dissolves the deposits, is considered to have had a better effect in the chromium fluoride bath than the sargent chromium bath [reaction formula (4) of FIG. 5]. It is also obvious that even immersion in chromic acid only has a lead elution effect.

(3) Chromate Processing

Faucet metals made of bronze casting are immersed in an alkaline etching solution (sodium hydroxide 50 g/1, meta-nitrobenzene sodium sulfonate 2 g/1, EDTA 2 g/1, ethylene diamine 2 g/1) for 3 minutes at 80° C. and then washed for 30 seconds. The faucet metals are subsequently immersed in a chromium fluoride plating solution (the above-mentioned bath on the market with a fluorine content of about 1 g/1) for 3 minutes at 45° C. and then, washed for 30 seconds. Next, chromate treatment is effected in a chromate solution with a composition as shown in FIG. 3 for 20 seconds at 30° C., washed for 30 seconds, and washed with hot water for 30 seconds at 60° C.

The faucet metals are then analyzed to obtain the elution concentration of lead in accordance with JIS S 3200-7 (1997). The analytic results are shown in FIG. 3.

As shown in FIG. 3, as compared with the case without chromate treatment, the lead elution amount of the product effected with chromate treatment is reduced, and the lead elution can be remarkably controlled, especially with the synergistic effect of chromic acid anhydride with phosphoric acid. Namely, with the synergistic effect of chromic acid and phosphoric acid contained in the chromate solution, a chemical reaction for dissolving a lead-containing copper alloy and a chemical reaction for forming chromate film are caused to remove the lead left in a limited amount on the surface of a lead-containing copper alloy material. By removing the lead, the chromate film is provided to protect the surface of the lead-containing copper alloy material. It is therefore possible to reduce elution of lead for a long time because the lead situated inside the lead-containing copper alloy material is not eluted even when the surface thereof corrodes due to water flow for a long time. With this chromate treatment, the chromate film is formed by a reaction formula in the schematic view showing the condition of chromate treatment in FIG. 6 to control elution of lead. It is obvious that even the chromate treatment only has a good effect on the elution of lead.

According to the present invention, by immersing drinking water service fittings made of lead-containing copper alloy in an alkaline etching solution to which an oxidant is added to remove lead on the surface thereof, it is possible to effectively reduce elution of lead used in the drinking water service fittings. If a chelating agent is added to this etching solution, it is possible to further improve prevention of lead elution.

The drinking water service fittings made of a lead-containing copper alloy are immersed in an alkaline solution to which an oxidant is added to remove lead on the surface thereof. They are subsequently immersed in a chromate solution to form a chromate film on the surface thereof. With this film formation, it is possible to remarkably reduce elution of lead.

By immersing the drinking water service fittings made of a lead-containing copper alloy in a chromic acid solution to which fluoride has been added to remove lead on the surface thereof, it is possible to effectively reduce elution of lead used in the drinking water service fittings.

After the drinking water service fittings made of a lead-containing copper alloy are immersed in an alkaline etching solution to remove lead on the surface thereof, they are further immersed in a chromic acid solution to which fluoride has been added. With this immersion, it is possible to remarkably reduce elution of lead.

If an oxidant and a chelating agent are added to the etching solution, it is possible to further improve prevention of lead elution.

Since the drinking water service fittings made of a lead-containing copper alloy are immersed in a chromate solution to which phosphoric acid is added to form a chromate film thereon, It is possible to effectively reduce elution of lead used in the drinking water service fittings.

The drinking water service fittings made of a lead-containing copper alloy are immersed in an alkaline etching solution and then immersed in a chromic acid solution to remove lead on the surface thereof. Since they are subsequently immersed in a chromate solution to which phosphoric acid has been added to form a chromate film on the surface, it is possible to remarkably reduce elution of lead.

The drinking water service fittings made of a lead-containing copper alloy are immersed in a chromic acid solution to which fluoride has been added to remove lead on the surface thereof. Since they are subsequently immersed in a chromate solution to form a chromate film on the surface thereof, it is possible to reduce elution of lead from the inside thereof and to remarkably reduce elution of lead.

Further, when the alkaline etching solution is used as a pre-processing agent for plating, it is possible to improve degreasing strength of stains and oil on the surface of a material and at the same time, to improve the outer appearance and adhesion of plating.

Still further, the drinking water service fittings made of a lead-containing copper alloy are immersed in an alkaline solution to remove lead on the surface thereof, and then immersed in a chromic acid solution to further remove lead on the surface thereof. Since they are subsequently immersed in a chromate solution to form a chromate film, it is possible to remarkably reduce elution of lead.

What is claimed is:

1. A processing method of reducing elution of lead from a lead-containing copper alloy, said method comprising:

immersing said lead-containing copper alloy in an alkaline etching solution, said solution comprising an oxidant;

wherein said immersing degreases the surface of said lead-containing copper alloy and removes lead as lead oxide on the surface of said alloy by said alkaline etching solution and promoting said removing lead by said oxidant, wherein said oxidant is sodium meta-nitrobenzene sulfonate.

2. A processing method of reducing elution of lead from a lead-containing copper alloy, said method comprising:

immersing said lead-containing copper alloy in an alkaline etching solution, said solution comprising an oxidant; wherein said immersing decreases a surface of said lead-containing copper alloy;

eluting an oxide lead into said alkaline etching solution, said oxide lead being obtained by oxidizing lead on a surface of said lead-containing copper alloy by using an oxidant, to remove lead on the surface of said alloy; and subsequently immersing said alloy in a chromate solution to form a chromate film on the surface of said alloy, wherein said alkaline etching solution has a pH about 13 or higher.

3. A processing method of reducing elution of lead from a lead-containing copper alloy, said method comprising:

immersing said lead-containing copper alloy in an alkaline etching solution, said solution comprising an oxidant; wherein said immersing degreases a surface of said lead-containing copper alloy;

eluting an oxide lead into said alkaline etching solution, said oxide lead being obtained by oxidizing lead on a surface of said lead-containing copper alloy by using an oxidant, to remove lead on the surface of said alloy; and subsequently immersing said alloy in a chromate solution to form a chromate film on the surface of said alloy, wherein said oxidant is sodium meta-nitrobenzene sulfonate.

4. A processing method of reducing elution of lead from a lead-containing copper alloy, said method comprising:

immersing said lead-containing copper alloy in an alkaline etching solution, said solution comprising an oxidant; wherein said immersing degreases a surface of said lead-containing copper alloy;

eluting an oxide lead into said alkaline etching solution, said oxide lead being obtained by oxidizing lead on a surface of said lead-containing copper alloy by using an oxidant, to remove lead on the surface of said alloy;

subsequently immersing said alloy in a chromic acid solution to further remove lead on the surface of said alloy; and subsequently immersing said alloy in a chromate solution to form a chromate film on the surface of said alloy.

5. The method of claims 4, wherein said solution further comprises a chelating agent.

6. The method of claim 4, wherein said alkaline etching solution has a pH about 13 or higher.

7. The method of claim 4, wherein said oxidant is sodium meta-nitrobenzene sulfonate.

8. The method of claim 4, said chromic acid solution comprises fluoride.

9. The method of claim 8, wherein said chromate solution comprises chromic acid anhydride, phosphoric acid and sulfuric acid.

10. The method of claim 4, wherein said chromate solution comprises chromic acid anhydride, phosphoric acid and sulfuric acid.

11. A processing method of reducing elution of lead from a lead-containing copper alloy, said method comprising:

immersing said lead-containing copper alloy in a chromic acid solution, said solution comprising fluoride, to remove lead on the surface of said alloy; and subsequently immersing said alloy in a chromate solution to form a chromate film on the surface of said alloy.

12. A processing method of reducing elution of lead from a lead-containing copper alloy, said method comprising:

immersing said lead-containing copper alloy in an alkaline etching solution, said solution comprising an oxidant, wherein said immersing degreases a surface of said lead-containing copper alloy, and removes lead on the surface of said alloy by said alkaline etching solution and promoting said removing lead by said oxidant, and said alkaline etching solution has pH about 13 or higher.

13. The method of claim 12 wherein said oxidant is sodium meta-nitrobenzene sulfonate.

14. The method of claims 12, wherein said solution further comprised a chelating agent.

15. A processing method of reducing elution of lead from a lead-containing copper alloy, said method comprising:

immersing said lead-containing copper alloy in an alkaline etching solution at a temperature between about 60° C. and about 90° C., said solution comprising an oxidant;

wherein said immersing degreases the surface of said lead-containing copper alloy and removes lead as lead oxide on the surface of said alloy by said alkaline etching solution and promoting said removing lead by said oxidant.

16. The method of claim 15 wherein the temperature is about 80° C.

* * * * *